United States Patent [19]

Koenig

[11] Patent Number: 4,535,331

[45] Date of Patent: Aug. 13, 1985

[54] PORTABLE TRAFFIC WARNING LIGHT

[76] Inventor: Kurt L. Koenig, P.O. Box 68, Arnold, Mo. 63010

[21] Appl. No.: 533,120

[22] Filed: Sep. 19, 1983

[51] Int. Cl.[3] ..... G08G 1/095; E01F 9/00

[52] U.S. Cl. ..... 340/908; 116/63 P; 40/612; 340/119; 340/145

[58] Field of Search ..... 340/908, 84, 107, 109, 340/119, 145; 116/63 P; 40/612, 550

[56] References Cited

U.S. PATENT DOCUMENTS

| | | | |
|---|---|---|---|
| 1,384,205 | 7/1921 | Maris | 340/145 |
| 2,528,962 | 11/1950 | Lieutard | 40/612 |
| 2,625,598 | 1/1953 | Broussard et al. | 340/84 |
| 2,717,376 | 9/1955 | Carpenter et al. | 340/907 |
| 2,819,547 | 1/1958 | Clements, Jr. | 40/612 |
| 2,838,744 | 6/1958 | De Wald | 116/63 P |
| 2,903,688 | 9/1959 | Sorensen | 340/109 |
| 3,161,853 | 12/1964 | Hart | 340/107 |
| 3,562,705 | 2/1971 | Paris | 340/908 |
| 3,622,980 | 11/1971 | Elledge | 340/82 |
| 3,867,718 | 2/1975 | Moe | 340/908 |
| 3,883,846 | 5/1975 | Bruner | 340/82 |
| 4,087,785 | 5/1978 | Dodich | 40/550 |

*Primary Examiner*—James J. Groody
*Attorney, Agent, or Firm*—Paul M. Denk

[57] ABSTRACT

A portable traffic warning light is disclosed having a lower base containing a power supply (e.g., a battery or battery pack), a lens housing including a number of electric lamps and lenses cooperable therewith which, when the lamps are energized, flash and/or display a warning message, and a pair of adjustable height columns supporting the lens housing on the base and permitting the height of the lens housing to be adjusted so as to permit ease of viewing by oncoming traffic under a variety of traffic situations.

5 Claims, 11 Drawing Figures

PORTABLE TRAFFIC WARNING LIGHT

BACKGROUND OF THE INVENTION

This invention relates to a traffic warning light, and more particularly to a portable traffic warning light which may be utilized by construction workers during road construction or repairs or which may be utilized by traffic officers warning oncoming traffic of an emergency ahead. More specifically, this invention relates to a portable traffic warning light which may be placed at a desired location on the road facing oncoming traffic, and energized so as to display flashing lights and displaying a message, such as SLOW or STOP to oncoming traffic.

In recent years, a variety of traffic warning devices have become known and reference may be had to the following U.S. Patents for a description of these prior art traffic signalling devices: U.S. Pat. Nos. Des. 172,026, 2,669,705, 2,717,376, 2,829,362, 2,838,744, 2,885,539, 2,903,688, 2,941,185, 2,975,412, 3,161,853, 3,622,980, 3,867,718, and 4,253,415.

Generally, these prior art traffic warning signal devices worked well for their intended purposes, but many of them did have certain shortcomings. For instance, oftentimes these devices did not clearly display information to oncoming traffic that may be approaching the construction or accident site at a rapid rate of speed such that oncoming drivers could readily ascertain what precautionary measures to take. Also, it was found to be sometimes highly desirable to be able to display messages in the form of words rather than merely flashing arrows or the like. Still further, it was found highly desirable to be able to adjust the height of the flashing light unit so that it would be most visible to the oncoming traffic, depending on the highway conditions and terrain. Yet, a number of these prior art traffic signalling devices were not readily height-adjustable.

SUMMARY OF THE INVENTION

Among the several objects and features of this invention may be noted the provision of a portable traffic warning light which may be operated independently of any stationary source of power;

The provision of such a portable traffic warning light which is of adjustable height so that the warning lights can be positioned so as to be most readily seen by oncoming traffic;

The provision of such a portable traffic warning light which can be utilized to display word messages as well as flashing arrows or the like;

The provision of such a portable traffic warning light in which one or more rows of the warning lights may be readily covered so as to prevent glare or other lights shining thereon;

The provision of such a portable traffic warning light which, in one embodiment, has its warning viewable by traffic approaching in opposite directions;

The provision of such a portable traffic warning light which is stable when in its errected position thereby to resist being blown over; and The provision of such a portable warning light which is of rugged and durable construction, which has a long service life, and which is reliable in operation.

Other objects and features of this invention will be in part apparent and in part pointed hereinafter.

Briefly stated, a portable traffic warning light of the present invention has a base, a lens housing, and a pair of height adjustable columns extending up from the base with the lens housing being supported atop the columns. The lens housing has a plurality of selectively energizable lamps mounted therein with each of the lamps having a lens associated therewith so as to display a warning signal to oncoming traffic when selected of the lamps are energized. The base includes a power supply (e.g., a battery pack or the like) for energization of the lamps.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
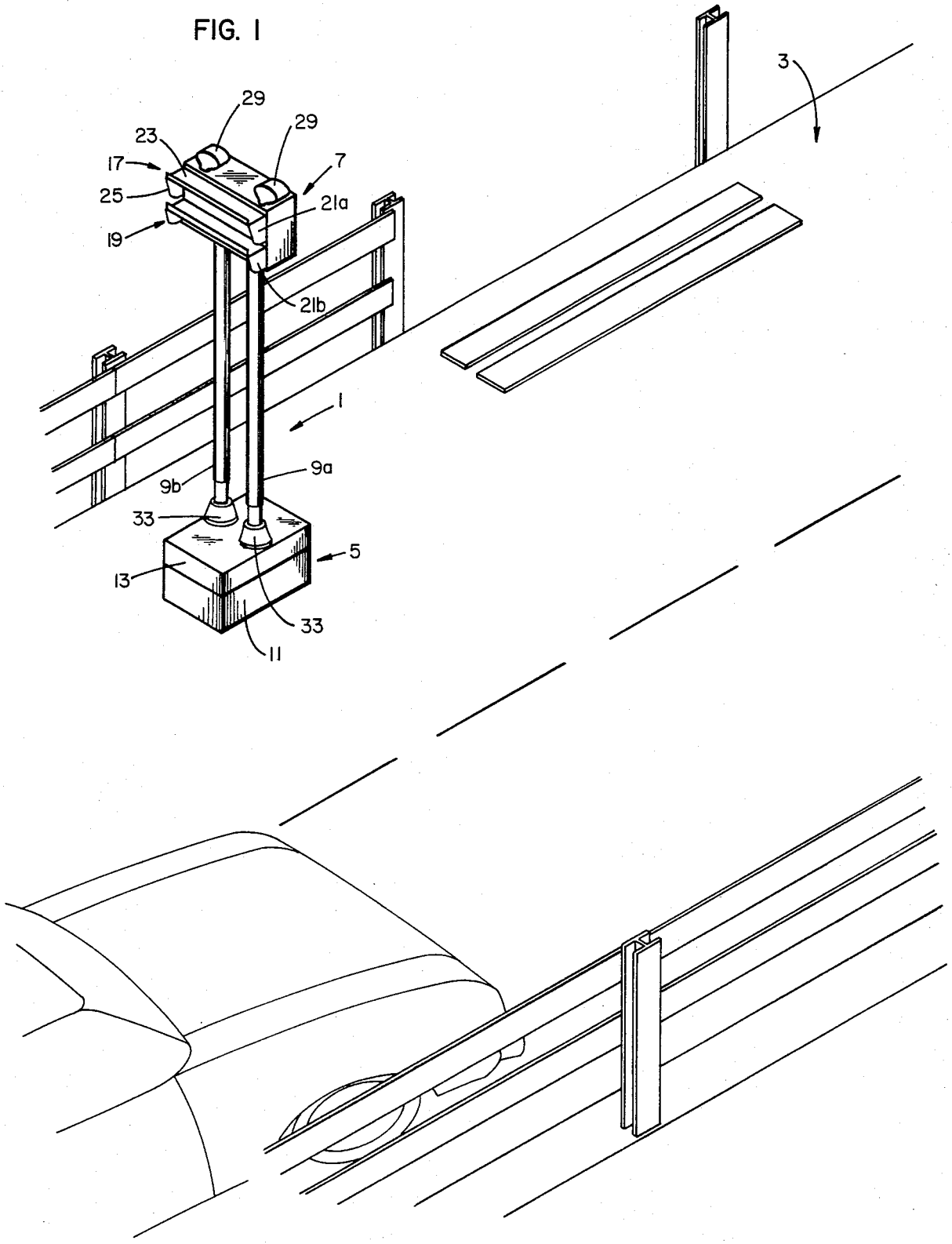
FIG. 1 is a perspective view of a portable traffic warning light of the present invention utilized on a roadway construction site.
Figure 2:
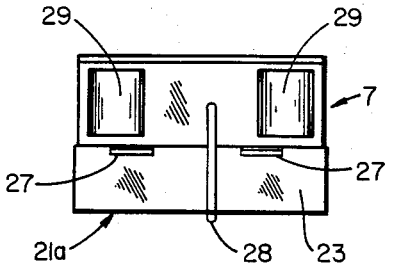
FIG. 2 is a top plan view of the warning light.

Referring now to the drawings, a portable traffic warning light of the present invention is illustrated in its entirety by reference character 1. The warning light, in FIG. 1, is shown to be located on a roadway 3 which is undergoing construction, so as to warn oncoming traffic or the like.

More specifically, traffic warning light 1 includes a base 5, and a lens housing 7 spaced above the base by means of a pair of height adjustable columns as indicated at *9a*, *9b*. More specifically, base 5 includes a lower base cabinet 11 covered by a removable base lid 13 secured to the lower base by means of latches 15. It will be appreciated that by unlatching latches 15, base lid 13 may be removed from the lower base thereby to provide access to one or more 12 volt batteries 45 constituting a power supply for the portable traffic warning light 1 of the present invention. Base 5 may be constructed of relatively heavy gauge sheet metal or the like and, with the batteries installed therein, has a considerable weight so as to provide a stable mounting base for the portable traffic light 1 when the latter is resting on roadway 3.

Referring now to lens housing 7, it is shown to have a top row 17 of electric lamps and associated lens, and a bottom row 19 of lamps and associated lens with the top row of lamps and lens being indicated at L1–L4, and with the bottom row being indicated by L5–L8. It will be appreciated that, for example, the top row of lens and lamps may be red while the bottom row 19 may be yellow. Further, the lens may have indicia thereon so that upon energization of the respective lamps, arrows or letters may be selectively illuminated to display flashing traffic directing arrows or warning words, such as SLOW or STOP.

The top and bottom rows are provided with a respective lens cover or hood, as generally indicated at 21*a*, 21*b*. More specifically, each of these lens covers is constituted by a cover top 23 extending horizontally outwardly from lens housing 7 above its respective row of lamps and lenses L1–L4 and L5–L8. Cover sides 25 extend downwardly from opposite sides of cover top 23. The cover top 23 is hingedly connected to lens housing 7 by means of hinges 27 and the cover top is held in its horizontal position by means of a latch member 28.

In operation, if it is desired to block one of the rows 17 or 19 of lamps and lens from the view of oncoming traffic, latch 28 may be disconnected from top cover 23 and the top cover may be swung downwardly on its respective mounting hinges 27 thereby to be disposed vertically in front of its respective row of lamps and lens. In this manner, the view of a selected row of lens may be blocked from the view of oncoming traffic thereby to prevent oncoming traffic viewing extraneous signals if the lamps are energized, or preventing distraction of oncoming drivers by the row of lamps that is not energized.

Additionally, lens housing 7 includes a pair of flashing lights 29 mounted on the top of the lens housing. In the embodiment shown in FIGS. 1–5, lamps L1–L4 and L5–L8 are mounted only on one face of the lens housing and the other vertical face of the lens housing is closed off by a back cover 31.

Figure 3:
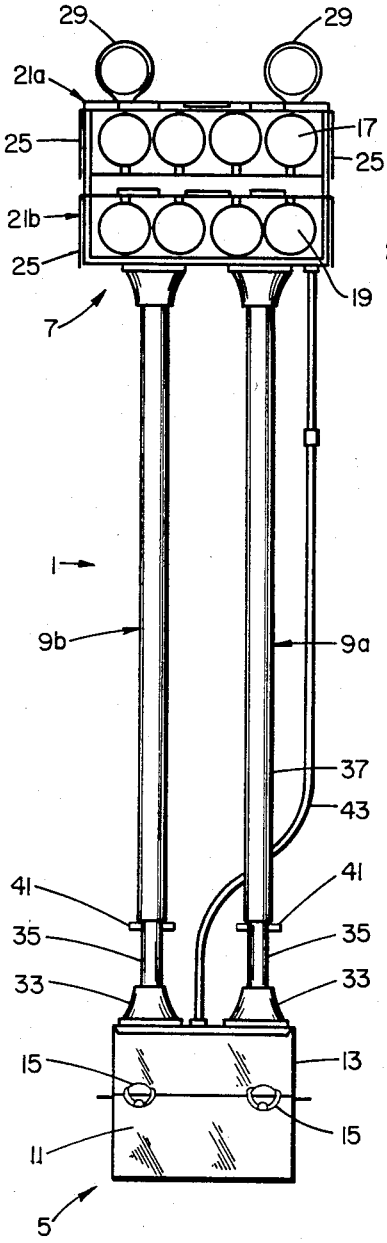
FIG. 3 is a front elevational view of the warning light.
Figure 4:
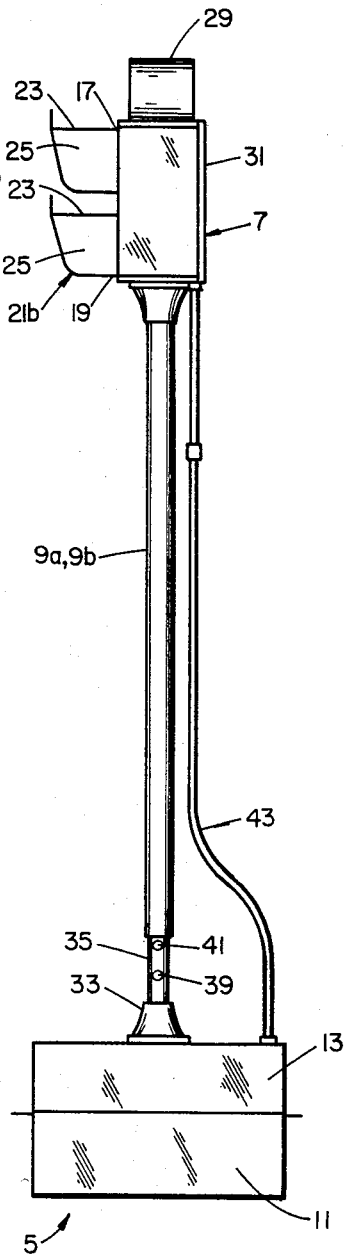
FIG. 4 is a right side elevational view of FIG. 3.
Figure 5:
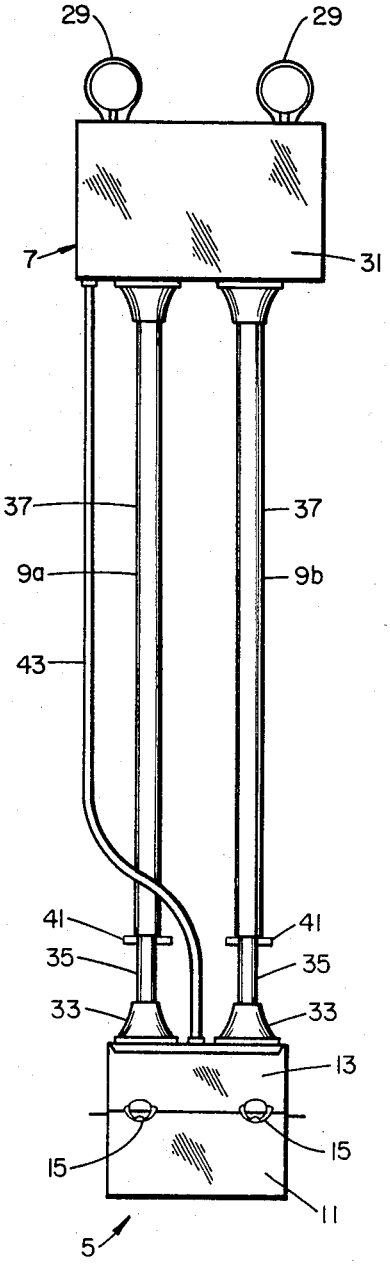
FIG. 5 is a rear elevational view of the warning light.

In FIGS. 3–4, telescopically adjustable columns 9*a*, 9*b* are shown to each be comprised of an inner column 35 and an outer column 37 telescopically fitting over the inner column. The inner column has a plurality of spaced holes 39 therethrough for receiving pins 41 thereby to locate outer column 37 at a desired extended telescopic position so as to permit vertical adjustment of lens housing 7 with respect to base 5. Additionally, power for the lamps contained in lens housing 7 is conducted from batteries 45 contained in base 5 by means of a flexible conduit 43. It will be appreciated that the length of flexible conduit 43 is sufficient to permit columns 9*a*, 9*b* to be extended to their fully extended positions, thus raising lens housing 7 above base 5 a maximum amount and yet will permit the lens housing to be moved relatively closely to the base housing without interference from the flexible conduit. Further, one set of columns 9*a*, 9*b* may be exchanged for a set of other columns of a different length so as to substantially increase or decrease the height of the traffic warning light.

Figure 6:
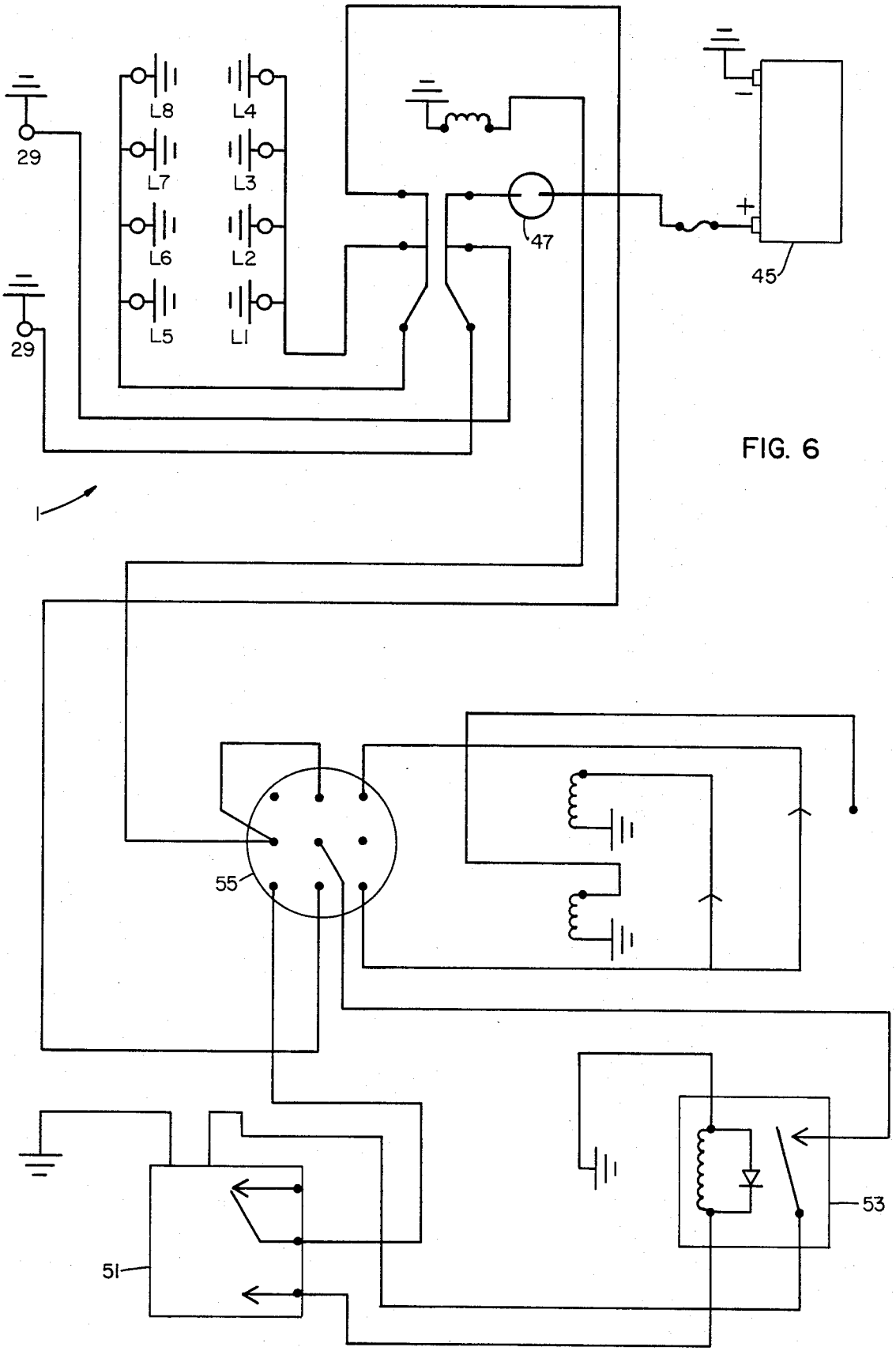
FIG. 6 is an electrical schematic of the power supply and control system for the portable warning light of the present invention.
Figure 7:
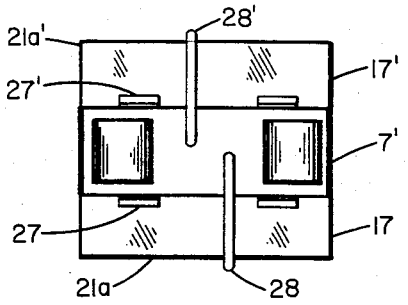
FIGS. 7–10 correspond generally to FIGS. 2–5, heretofore described, and illustrate an alternative embodiment of the portable traffic warning light having warning lamps on both faces of the lens housing such that traffic approaching the warning light from opposite directions may be warned.
Figure 8:
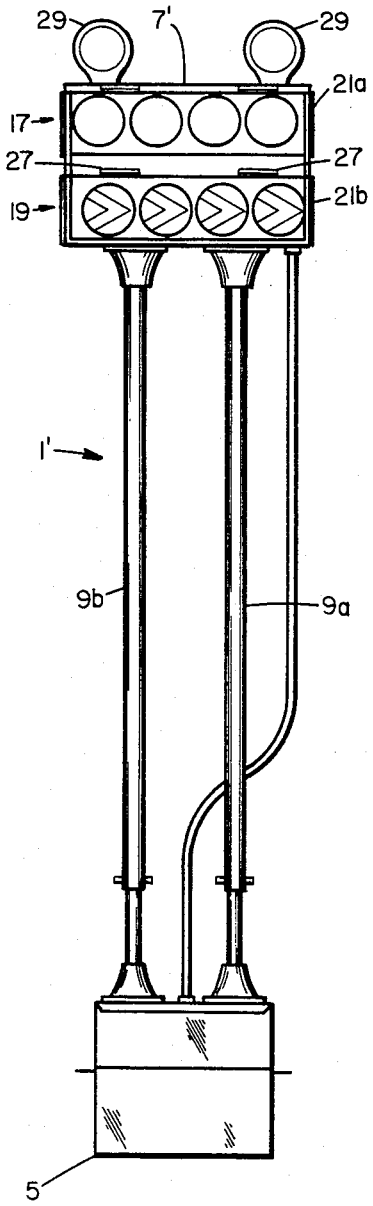
Figure 9:
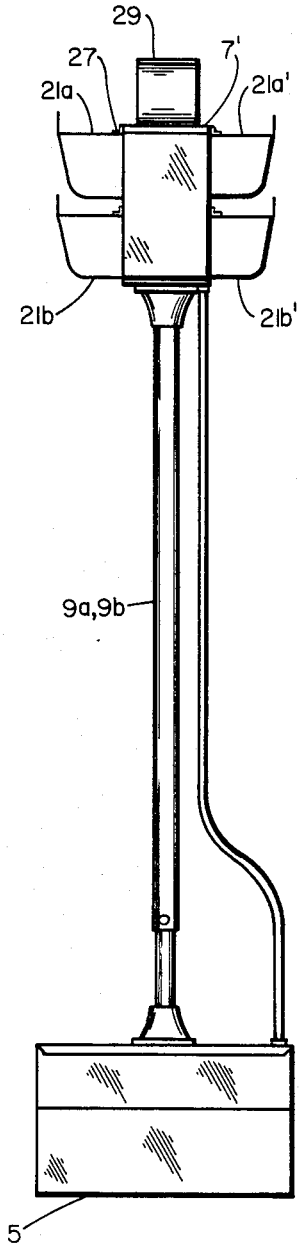
Figure 10:
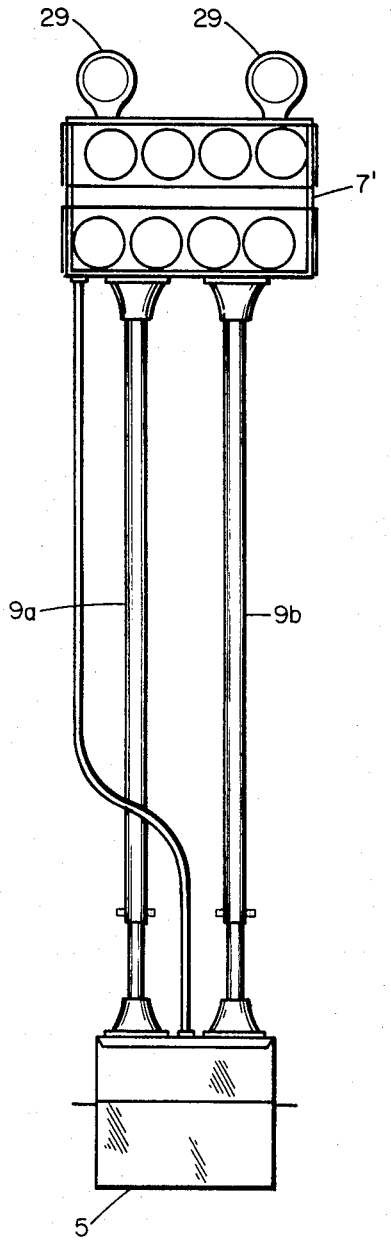

Referring now to FIG. 6, an electrical schematic for controling the portable traffic light 1 of the present invention is shown. The power supply is shown to be comprised by one or more 12-volt automotive type batteries, as indicated at 45, which supply power to an intermittent flasher 47 for flashing lamps L1–L4 and L5–L8, as well as lamps 29 on and off.

In accordance with this invention, traffic warning light 1 of the present invention may be remotely controlled by a radio transceiver 51 so that one of the traffic warning lights 1 may be placed at one end of a road construction site, and so that another of the traffic warning lights may be placed at the other end of a consruction site, for example, 500 feet apart, and so that a single workman may control both of the lamps so as to control the flow of traffic past the construction site. For example, one of the traffic warning lights may be operated in a mode indicating that traffic in one direction should proceed showly while traffic in the opposite direction should remain stopped. After a number of cars have proceeded past the construction site, the workman controlling operation of the traffic lights may send a signal to both of the traffic lights 1 thereby changing their displays so as to stop traffic now moving and, after a predetermined length of time, permit the previously stopped traffic to move past the construction site. Toward that end, transceiver 51 supplies power to a time delay relay 53 which in turn supplies power to a three-pole double throw switch 55. The latter controls energization of the top and bottom rows of lamps 17 and 18.

Referring now to FIGS. 7–10, an alternative embodiment of the portable traffic warning light of the present invention is indicated in its entirety by reference character 1'. Essentially, traffic warning light 1' is similar to traffic warning light 1 heretofore described, but for the provision of lens housing 7' having rows of lamps 17 and 19 on one face thereof and rows 17' and 19' on the other face thereof such that traffic approaching the traffic warning light from opposite directions may be warned or directed by the traffic warning light. It will be appreciated that the "primed" reference numbers indicate parts having a corresponding construction and function to similar parts heretofore described and, thus, a detailed description of the construction and operation of the lamp 1' is omitted for purposes of brevity.

Figure 11:
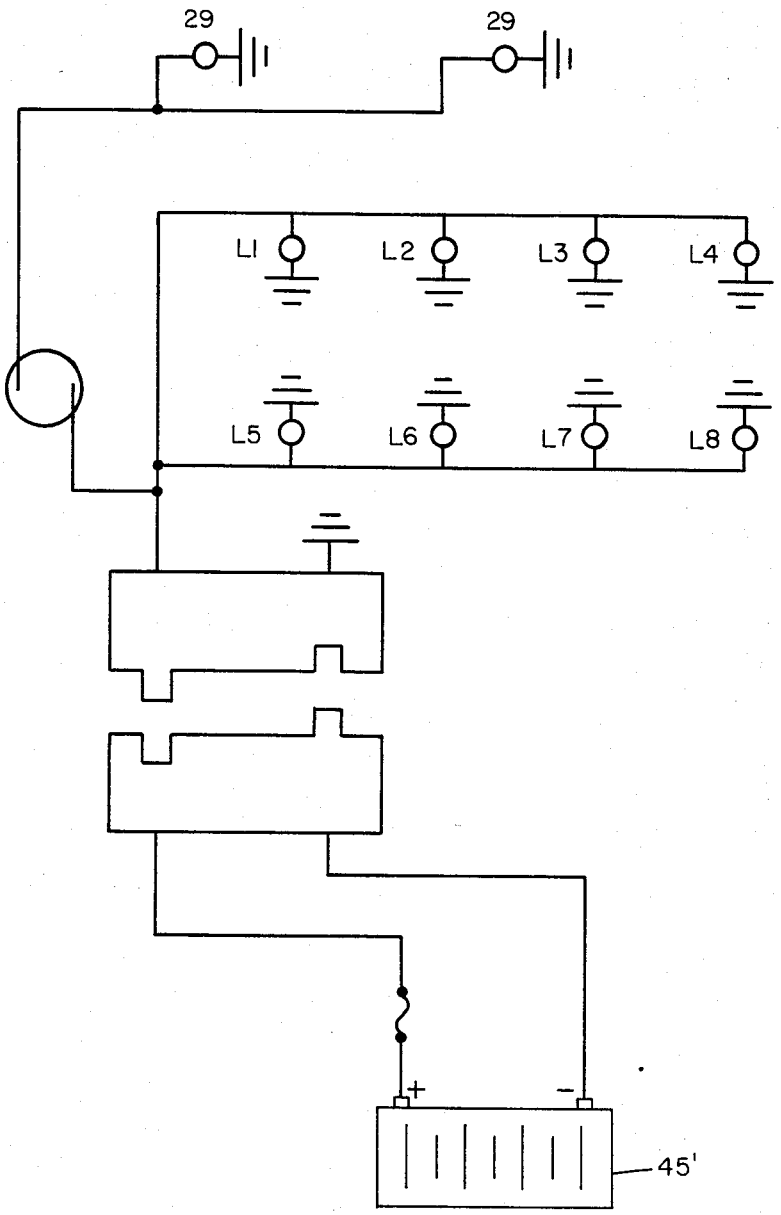
FIG. 11 is an electrical schematic of the electrical warning light illustrated in FIGS. 7–10.

FIG. 11 is a schematic of an alternative power supply for energization of the lamps of the traffic warning light 1 of the present invention with corresponding reference characters indicating parts having a corresponding construction and function to parts heretofore described in regard to FIG. 6.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A portable traffic warning light having a base for support directly upon the ground, a lens housing, and a pair of columns extending up from said base, said columns being adjustable heightwise, said lens housing being supported on top of said adjustable columns, said lens housing having a plurality of selectively energizable lamps mounted therein with each of said lamps having a lens associated therewith so as to display a warning signal to oncoming traffic when selected of said lamps are energized, said base including a power supply for energization of said lamps, said power supply comprising at least one battery installable in said base, said battery aiding in and stabilizing said base and traffic warning light as it rests upon the ground, said columns being telescopically adjustable so as to vary the heighth of said lens housing above said base, said columns being detachable from said base and from said lens housing such that one pair of relatively short columns may be exchanged for a pair of relatively longer columns or vice-versa so as to vary the heighth of said lens housing, and a flexible power cable connecting said power supply to said lens housing, with said flexible power cable permitting vertical adjustable movement of said lens housing with respect to its supporting base.

2. A portable traffic warning light as set forth in claim 1 wherein said lens housing has said lens arranged in at least one horizontal row, said lens housing having a lens hood hingedly secured to said housing for movement between an open position in which the lens of at least said one row are visible by oncoming traffic and are at least partially shielded from glare and from traffic out of line with the oncoming traffic, and a closed position in which said lens hood covers said lens of said at least one said row.

3. A portable traffic warning light as set forth in claim 2 including means for intermittently flashing said lamps on and off, in a selected, repeated pattern.

4. A portable traffic warning light as set forth in claim 2 further comprising a top row of lamps and a bottom row of lamps, each of said rows of lamps having a respective lens hood associated therewith.

5. A portable traffic warning light as set forth in claim 2 wherein said lens housing has said lens on opposite faces thereof.

* * * * *